United States Patent [19]

Malone

[11] 3,955,720

[45] May 11, 1976

[54] LOW PRESSURE DISPENSING APPARATUS WITH AIR PUMP

[76] Inventor: David C. Malone, 2281 SW. 33rd Way, Fort Lauderdale, Fla. 33312

[22] Filed: Oct. 25, 1973

[21] Appl. No.: 409,739

Related U.S. Application Data

[63] Continuation-in-part of Ser. No. 306,517, Nov. 15, 1972, abandoned.

[52] U.S. Cl. ..... 222/396; 222/397; 222/401; 239/360; 417/440

[51] Int. Cl.² ..... B65D 83/14

[58] Field of Search ..... 239/355, 356, 359, 363, 239/360; 222/396, 400.8, 401, 402, 394, 397; 417/443, 550, 552, 283, 440

[56] References Cited

UNITED STATES PATENTS

| | | | |
|---|---|---|---|
| 1,170,756 | 2/1916 | Kelley | 417/443 X |
| 1,396,494 | 11/1921 | Wright | 222/401 |
| 1,745,024 | 1/1930 | Malone | 417/443 X |
| 2,031,172 | 2/1936 | Maloney | 222/400.8 X |
| 2,106,620 | 1/1938 | Nilson | 417/443 X |
| 2,481,719 | 9/1949 | Buck | 222/400.8 X |
| 2,753,080 | 7/1956 | Bartlett | 222/400.8 X |
| 2,995,278 | 8/1961 | Clapp | 222/394 |
| 3,127,070 | 3/1964 | Brickman | 222/400.8 X |
| 3,357,601 | 12/1967 | Crawford et al. | 222/397 |

FOREIGN PATENTS OR APPLICATIONS

| | | | |
|---|---|---|---|
| 725,121 | 5/1932 | France | 222/401 |

*Primary Examiner*—Robert B. Reeves
*Assistant Examiner*—David A. Scherbel
*Attorney, Agent, or Firm*—Harness, Dickey & Pierce

[57] ABSTRACT

A reuseable dispensing apparatus for dispensing a flowable product by pressurized air, comprising a refillable container for the product to be dispensed and an air pump operable by the user to pressurize the container after filling. The air pump has a conveniently grippable and storable handle. A user-actuable dispensing valve on the container dispenses product utilizing pressurized air as a propellant. Apparatuses are provided to permit the container to be depressurized at any time without product being dispensed, to relieve pressure in the pumping chamber either automatically at operating pressure or manually at any lesser pressure, and to permit the pumping handle to be conveniently stored with respect to the container. The apparatus can operate at relatively low pressure and can be made almost entirely of plastic.

35 Claims, 27 Drawing Figures

Fig. 1
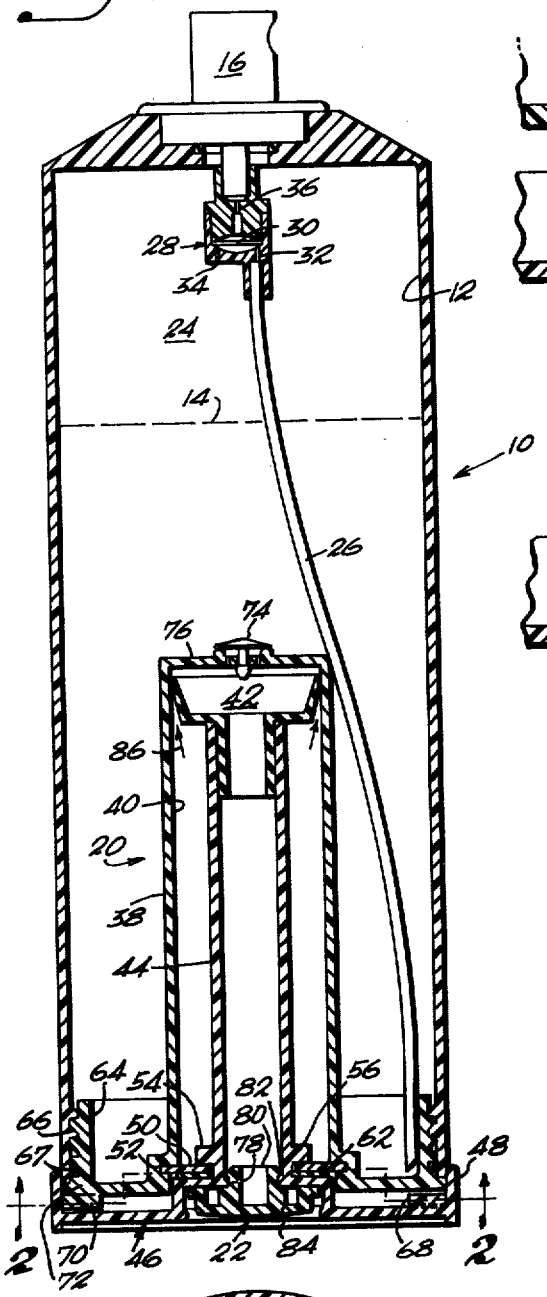
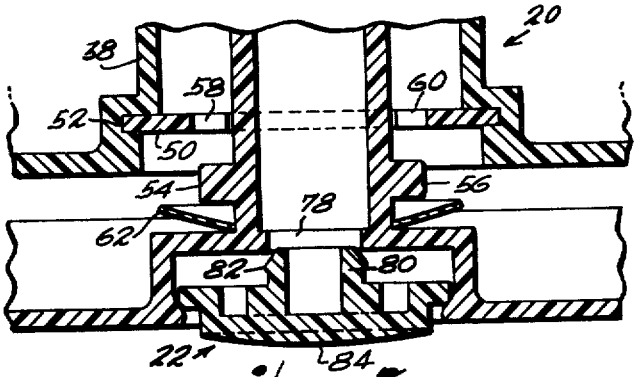
Fig. 3
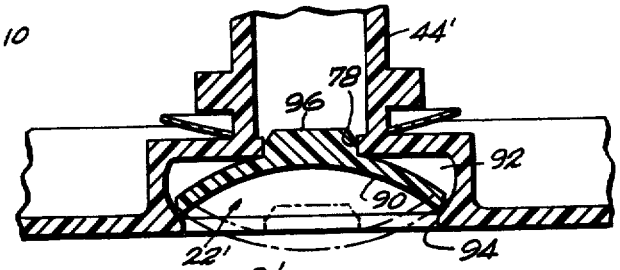
Fig. 4
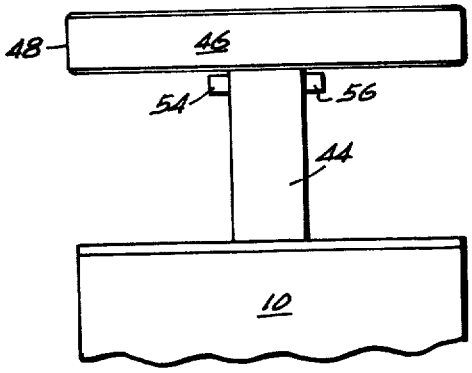
Fig. 5
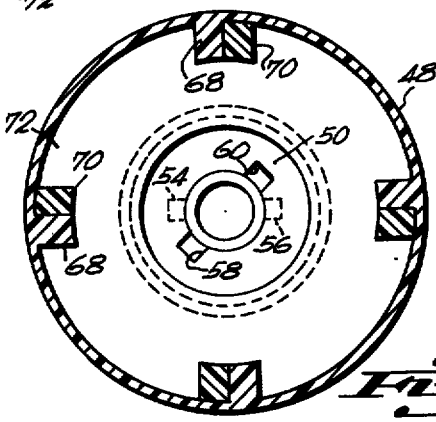
Fig. 2
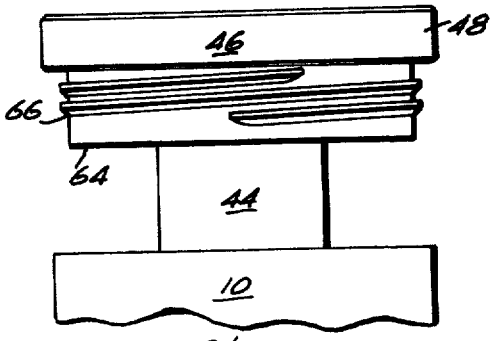
Fig. 6

LOW PRESSURE DISPENSING APPARATUS WITH AIR PUMP

CROSS REFERENCE TO RELATED APPLICATION

The present invention is a continuation-in-part of applicant's prior application Ser. No. 306,517, filed Nov. 15, 1972 for Low Pressure Dispensing Apparatus, now abandoned, the disclosure of which is incorporated herein by reference.

BACKGROUND AND SUMMARY OF THE INVENTION

Generally, dispensing equipment falls broadly into three categories: first, the typical finger operated pump sprayer; next, the various versions of pump sprayers that are manually operated by means of a trigger or handle, or the squeeze bottle type; and lastly, the broad field of pressurized containers commonly referred to as "aerosol bombs". This latter group depends entirely upon a gas propellant, usually one of the halogenated hydrocarbons, especially the flurocarbons. This propellant is a liquid at a low temperature and/or high pressure but it boils rapidly at ordinary room temperatures and pressures, creating tremendous volumes of gas to dispense many commonly used products. Although aerosol bomb type dispensers are in wide-spread commercial use, they inherently possess at least several undesirable and potentially dangerous characteristics. The Medical Profession has already documented the serious health hazards associated with the inhalation of the propellant vapors. The dispenser is potentially explosive at elevated temperatures which create explosively high propellant pressures within the container. In fact, certain laws require that warnings be placed on the container cautioning the user of the aerosol bomb from exposing the container to elevated temperatures and warning against the danger of puncturing the container. Other associated problems, such as the need for metal containers due to the high pressures involved, cause additional disadvantages, i.e., the silent danger of electrolysis and corrosion, along with potential contamination of product to be dispensed by the gas propellant. Furthermore, aerosol bombs are not reuseable and pose a serious ecological problem caused by the daily disposition of astronomical quantities of empty aerosol containers. On the other hand, all manually or finger-operated pump sprayers depend entirely on the human effort, resulting in variable spray quantities in direct proportion to the physical capabilities of the operator. Many of these spray devices dribble, deliver coarse, wet and/or excessive quantities, oftimes leak, fail to operate and, generally, are not too dependable. Various types of pressurized liquid dispensers incorporating manual pumping and dispensing means have been provided. The devices are typically used for dispensing beverages and generally are quite complicated and cumbersome, and not at all suited for the same applications as an aerosol bomb type dispenser.

The novel low-pressure dispensing apparatus of the present invention provides a much needed alternative to the aerosol bomb type of dispenser with its inherent dangers, caused by its vapors and explosive qualities, and to finger operated pump sprayers and trigger or handle operated sprayers with their attendant deficiencies.

Among the principal objects of the present invention are to provide a dispenser for materials such as liquids (as an aerosol or as a liquid jet), foams and powders, which is reuseable, easy to use, foolproof in operation, can use ordinary air as propellant, presents a minimum health hazard, is not as subject to harmful explosion or leakage as high pressure dispensers, is competitively priced and will dispense most materials as well as or better than an aerosol bomb without the aforementioned perils and hazards associated with this latter type. With the present invention the container can be entirely plastic; this affords even further advantages and benefits. Not only is plastic relatively inert and non contaminating, but its use permits molding much of the structure of the dispensing apparatus integrally with the container itself, thereby eliminating many individual parts and the assembly thereof into the container. Most of the separate operating parts of the dispenser can also be made of plastic. Accordingly, the construction of the dispensing apparatus of the present invention is especially economical and well adapted for mass-production techniques. Furthermore, the apparatus can be refilled and reused a number of times.

The invention also possesses novel operating features heretofore not attained in dispensing apparatus of this type. The container can be pressurized to any desired pressure up to a preset maximum which cannot be exceeded; the container can be de-pressurized at any time without dispensing any product from the container; and the pumping mechanism for pressurizing the container can be compactly stored and sealed in relation to the container and includes a conveniently grippable operating handle.

The foregoing features along with additional advantages and benefits of the invention will be seen in the ensuing description and claims which are to be taken in conjunction with the accompanying drawings.

BRIEF DESCRIPTION OF THE DRAWINGS

FIG. 1 is a vertical sectional view through a first form of low pressure dispensing apparatus in accordance with the present invention;

FIG. 3 is a substantially enlarged fragmentary sectional view of the bottom portion of FIG. 1 with the pump means in a disabled pumping position;

FIG. 4 is a cross sectional view of a modified form of disabling means;

FIG. 5 is a fragmentary elevational view of the bottom portion of the container in an inverted position with the pump handle extended in an operating position;

FIG. 6 is a view similar to FIG. 5 with the removable pump assembly attached to the pump handle whereby the entire pump assembly may be removed to permit refilling of the container;

FIG. 13 is a vertical sectional view, similar to FIG. 1, illustrating a still further form of the present invention;

FIG. 25 is a view similar to FIG. 23 but illustrating an operative position of the reset mechanism which automatically prevents the pumping mechanism from pressurizing the dispensing apparatus beyond a desired pressure;

FIG. 26 is a view similar to FIG. 23 but illustrating an operative position of the pumping and reset mechanism which permits pressurized gas only to be released from the dispensing apparatus.

DESCRIPTION OF THE PREFERRED EMBODIMENTS

Figure 7:
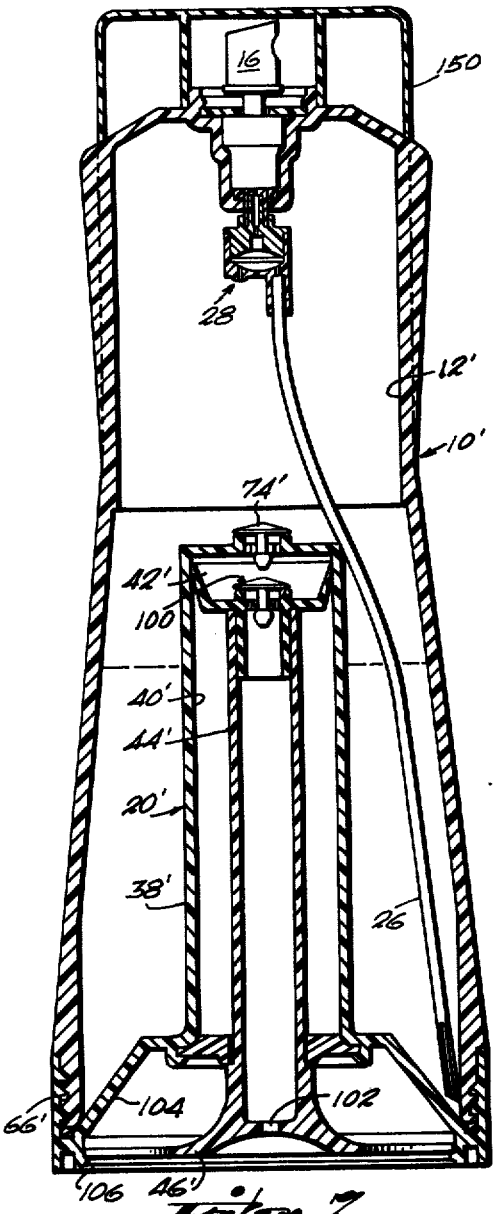
FIG. 7 is a vertical sectional view, similar to FIG. 1, illustrating another form of the present invention.
Figure 8:
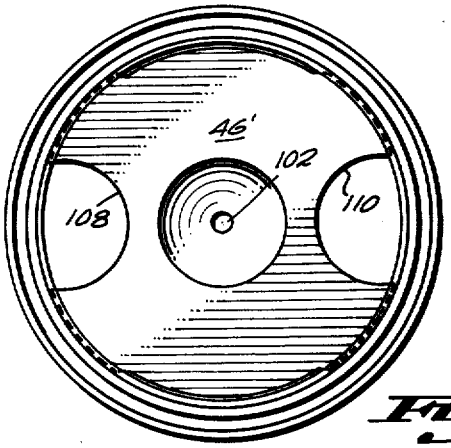
FIG. 8 is a bottom plan view of FIG. 7.
Figure 9:
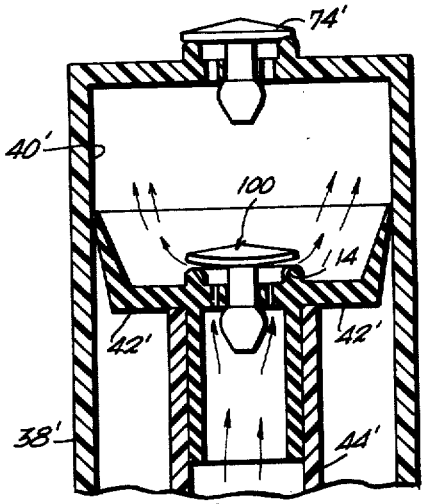
FIGS. 9, 10 and 11 are enlarged sectional views of the piston and valve means of the pump, illustrating a series of operational relationships between the valves and piston.

With reference to the drawings, in which like reference numerals designate like or corresponding parts throughout the various views, and with particular reference to FIG. 1, the numeral 10 generally indicates a container preferably fabricated of a suitable plastic material, providing an enlarged inner chamber 12, normally filled with product to be dispensed to the level 14 by actuation of a conventional spray nozzle 16 carried at the top of the container 10.

In its basic concept, the device of the present invention employs a low pressure liquid dispensing system whereby, in a closed container, internal air pressurization is quickly and easily accomplished by means of a novel self-contained pump structure 20 which incorporates automatic disabling means 22 to prevent further pressurization of the inner chamber 12 beyond a predetermined level.

The dispensing system employs at its "energy source" the pressurized air contained in the head space 24 of the chamber 12 to directly convey the product in the chamber 12 to the spray nozzle 16 by means of a dip tube 26; or, alternatively, as illustrated in FIG. 1, the product is conveyed to a mixing device 28 through the dip tube 26. The mixing device 28 provides an aerosolizing chamber 30 into which the material from the dip tube 26 is introduced through an orifice 32. Pressurized air from the head 24 enters the chamber 30 through a second orifice 34 and the product to be sprayed and the pressurized air automatically combine therein into an ideal, true aerosol spray which is dispensed from the nozzle 16, when actuated, through an orifice 36 communicating between the chamber 30 and the nozzle 16.

With further reference to FIG. 1, the self-contained pump structure 20 comprises generally an elongated cylinder housing 38, extending vertically upwardly from the bottom of the container 10 into the chamber 12, and providing an interior cylinder 40. Within the cylinder 40, a cup-shaped piston 42 is reciprocably mounted on the upper end of a tubular piston stem 44. A handle portion 46, formed integral with the outer end of the piston stem 44, is designed with a peripheral flange 48 to snugly slip-fit over the bottom periphery of the container to form a bottom retainer cover therefor.

Figure 2B:
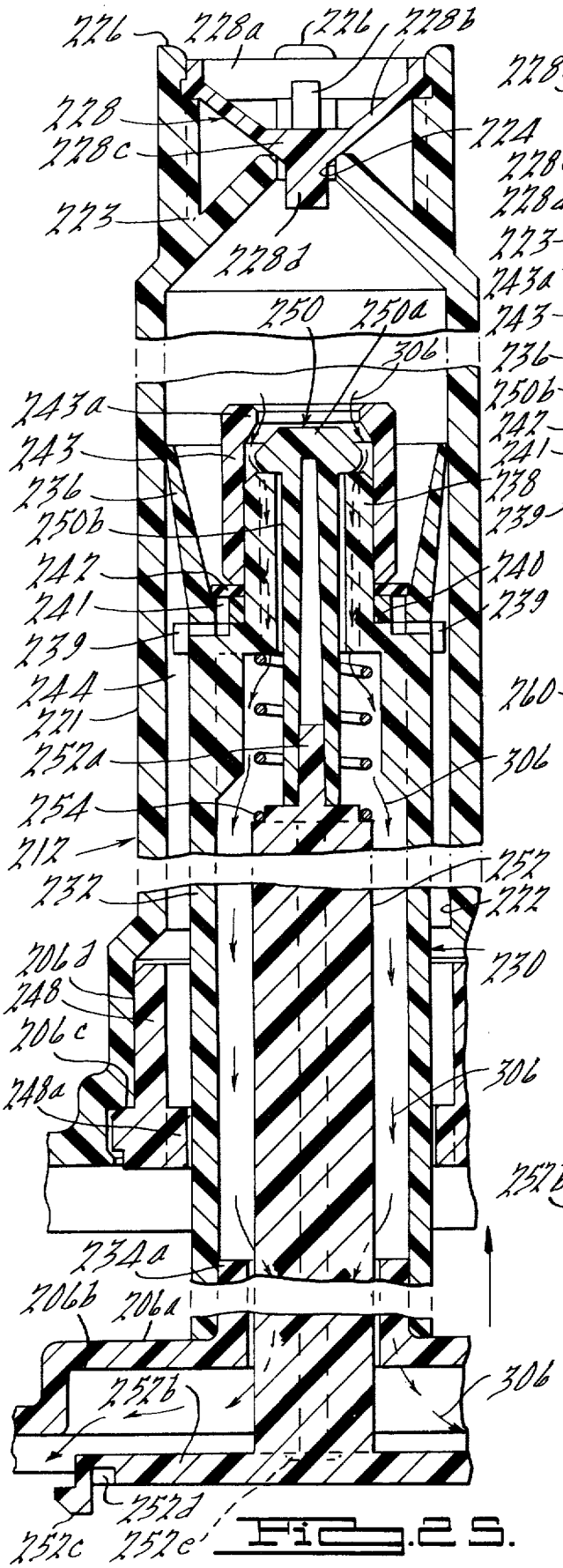
FIG. 2 is a cross sectional view, looking upwardly, as indicated by the arrows 2—2 in FIG. 1.
Figure 2A:
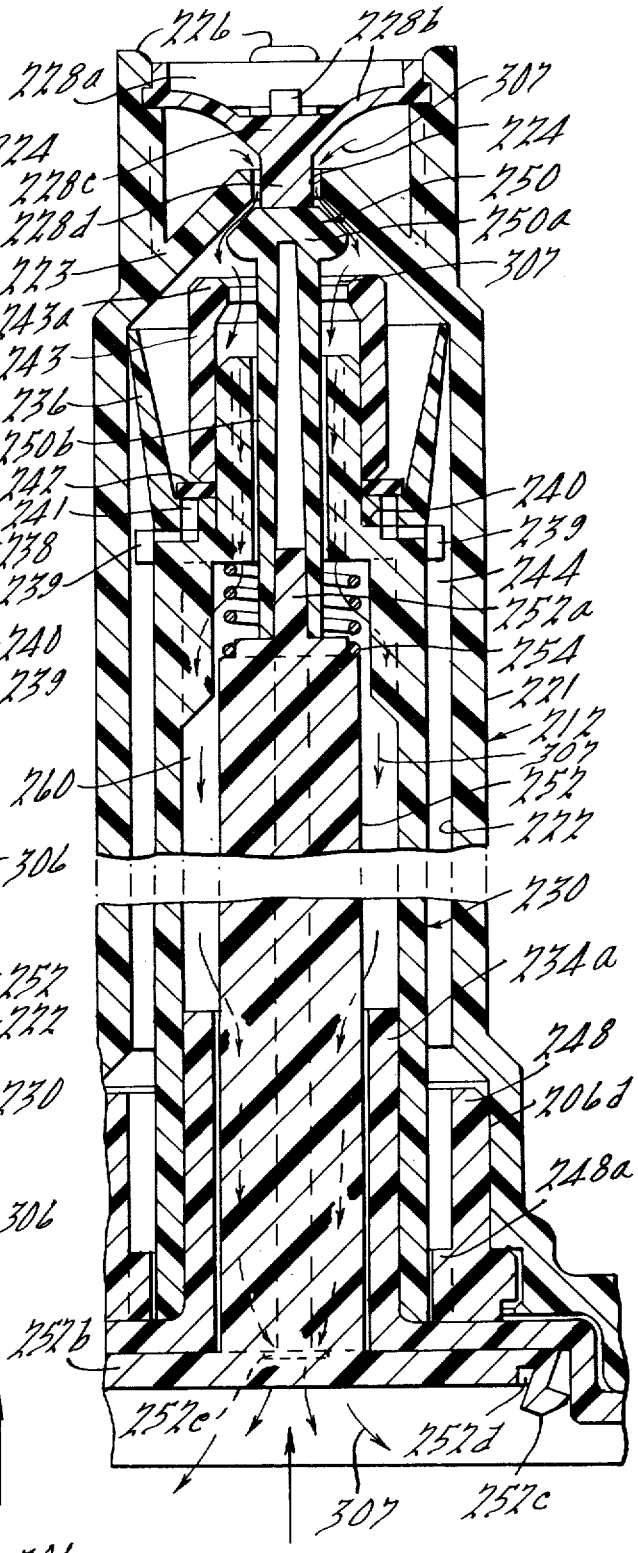

A piston stem retainer ring 50 is fixedly held in an inner annular groove 52 in the lower end portion of cylinder housing 38 and diametrically opposed, outwardly extending pins 54 and 56 from the lower end portion of the piston stem 44, above the handle 46, are adapted to engage through corresponding slots 58 and 60 in the retainer ring 50 to selectively lock and unlock the piston 42, stem 44 and handle 46 relative to the cylinder housing 38 (see FIG. 2).

As best illustrated in FIG. 3, a spring washer 62, preferably of a suitable molded plastic, is disposed between the retainer ring 50 and the pump handle 46 to serve two purposes. First, when the pins 54 and 56 are locked through the slots 58 and 60, the spring washer 62 exerts sufficient tension to prevent accidental unlocking. Second, when the container 10 is inverted as in FIG. 5 and the pins 54 are unlocked relative to slots 58 and 60, the handle 46 automatically "pops up", under the spring pressure of washer 62 and is ready for use in a manner to be subsequently described.

Referring back to FIG. 1, the cylinder housing 38 is provided with an outer annular flange 64 in internal screw-threaded engagement at 66 with the lower end of the container 10. An O-ring 67 carried in the annular flange 64 seals against the inner wall surface of said container 10. To permit easy removal of the entire pump assembly for filling or refilling of the container 10, a plurality of inwardly extending lugs 68, from the interior surface of the handle 46, are adapted to rotatably engage a like plurality of outwardly extending lugs 70 from a ring portion 72, interconnecting the cylinder housing 38 and the screw-threaded annular flange 64. When the handle 46 is properly rotated, the screw-threaded engagement shown at 66 is disengaged and the pump assembly is removed as illustrated in FIG. 6. After the container 10 is filled or refilled, the handle 46 is manipulated to re-engage the screw threads 66.

A one-way valve 74 is axially disposed in the top closure wall 76 of the cylinder housing 38 and the disabling means 22 is in axial alignment with valve 74 in closing relation to a bottom through opening 78 in the tubular valve stem 44. The disabling means 22 comprises a plug including an inward projection 80 having an annular bead 82 thereabout which is adapted to snap into a firmly seated relation through the opening 78, and an enlarged outer portion 84 which serves as a "push button" or "reset button".

In operation, the container is up-ended and the entire pump assembly is removed as previously described relative to FIG. 6. The container is then filled or refilled, as the case may be, and the entire pump assembly is re-engaged with the container 10. To pressurize the container, the handle 46 is rotated to disengage the pins 54 and 56 from the slots 58 and 60 and pulled outwardly as in FIG. 5 and manually pumped to impart a reciprocating movement to the piston head 42 which is made of a suitable resilient material. On the outstroke, the resilient material of the piston 42 flexes inwardly permitting air to pass into the cylinder 40 above the piston head 42, indicated by the arrow 86; on the in-stroke, the air above the piston head is forced through the one-way valve 74 into the head portion 24 of the container chamber 12.

If the pumping action is continued until the head 24 is pressurized to a predetermined level representing maximum desired pressure in the container, back pressure through the tubular piston stem 44 causes the disabling means 22 to snap open (FIG. 3), rendering the pump inoperable until the push button portion 84 of the disabling means 22 is manually actuated to reengage the annular lock head 82 through the opening 78. When means 22 snaps open the one-way valve 74 quickly closes, retaining the proper pressure head. The conventional spray nozzle 16 may then be actuated whereupon the pressure in head 24 forces the contents of the container 10 upwardly through the dip tube 26, into the mixing chamber 30; pressurized air in a jet stream enters the chamber 30 through orifice 34, mixes with the material from the container and is discharged through the orifice 36 and spray nozzle 16 as a true aerosol spray.

FIG. 4 illustrates a modified form of disabling means 22', comprised of a disc 90, normally inserted into the enlarged opening 92, at the outer end of the tubular valve stem 44', which is provided with a restricted mouth opening at 94. A beveled edged, annular boss 96, integral with the disc 90, is disposed to provide a tight closure for the opening 78 when the disc 90 is manually flexed from its broken line position to its full line position in FIG. 4.

FIGS. 7 through 11 illustrate another form of the present invention and will be described only insofar as it differs from the form of FIGS. 1 through 6, the actual transfer of the pressurized contents from the container 10' being the same as in both forms.

The pump means 20' produces the same end results, however, the disabling means 22 of the first form of the invention is replaced by a unique two-way valve 100, axially disposed in the piston head 42' in alignment with the one-way valve 74' in the cylinder, and with the tubular piston stem 44' which is open to the atmosphere through a hole 102 at the bottom thereof.

The cylinder housing 38' is in screw-threaded engagement at 66' with the lower end of the container 10'. However, the handle 46' is nested inside of the screw-threaded extension 104 of the cylinder housing 38' and is restrained against accidental movement by an inner, annular lock bead 106, over which the handle 46' is manually snapped. When it is desirable to actuate the piston head 42' to pressurize the container 10', the operator inserts two fingers through the diametrically opposed cut-outs 108 and 110 and snaps the handle 46' outwardly, free of the lock bead 106. The pumping operation then progresses in the same manner as described relative to the first form of the invention.

Figure 10:
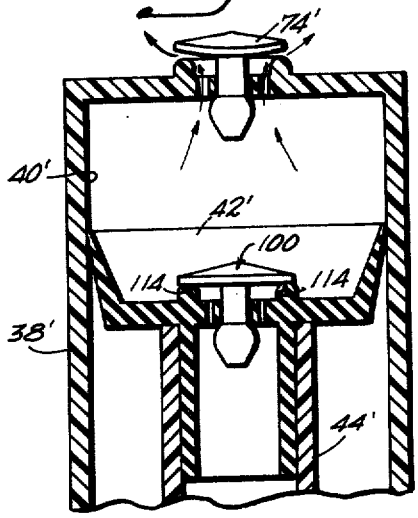

When the piston head 42' is withdrawn outwardly, air passes through the hole 102, stem 44' and two-way valve 100 (FIG. 9) into the cylinder 40' above the piston head 42'. FIG. 10 illustrates the inward stroke of the piston head 42', the pressure closes the two-way valve 100 and opens the one-way valve 74' into the container chamber 12'.

Figure 11:
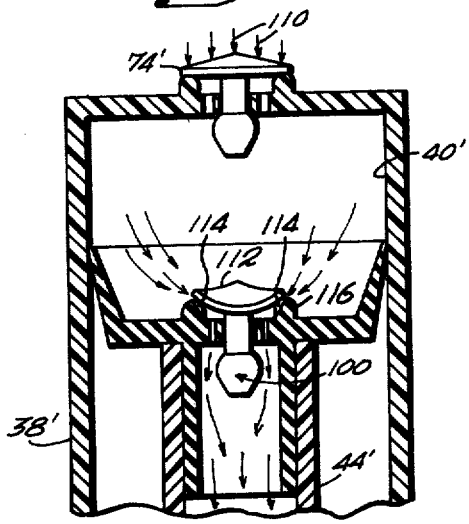

FIG. 11 illustrates the condition when maximum desired pressure is reached in the chamber 12'. Pressure build-up exterior of one-way valve 74', indicated at 110, holds said valve closed. Further inward pumping movement of the valve head 42' causes the head of the two-way valve 100 to become deformed as at 112, permitting the built-up pressure, above the piston head 42' to escape through a plurality of grooves 114, peripherally spaced about the seat 116. Therefore, the pump is rendered completely inoperable.

Figure 12:
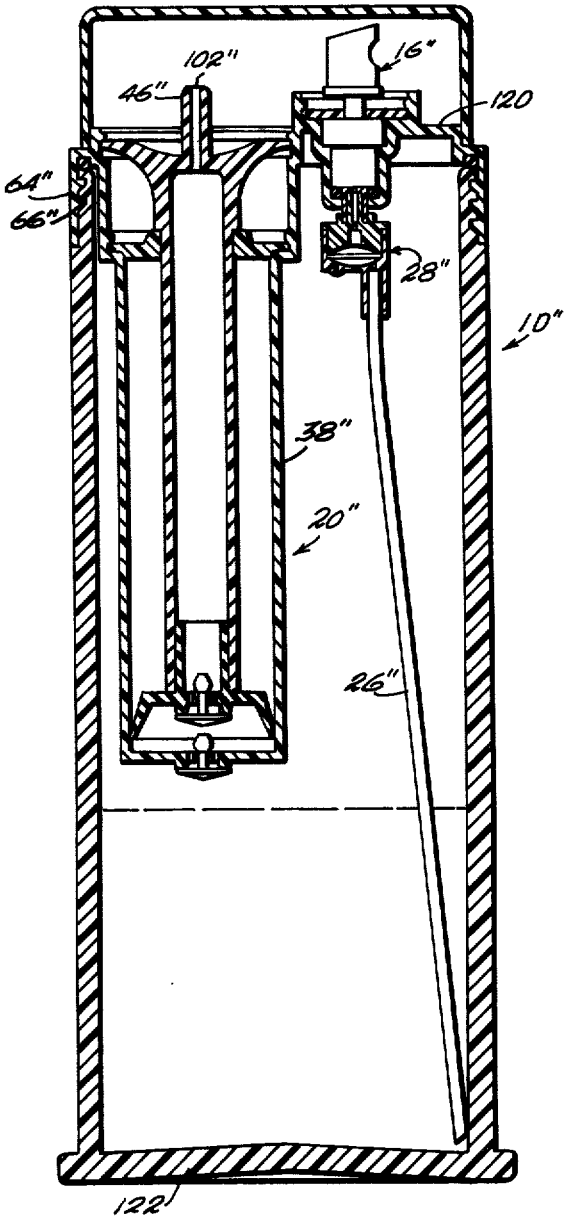
FIG. 12 is a vertical sectional view, similar to FIG. 1, illustrating a further form of the present invention.
Figure 15:
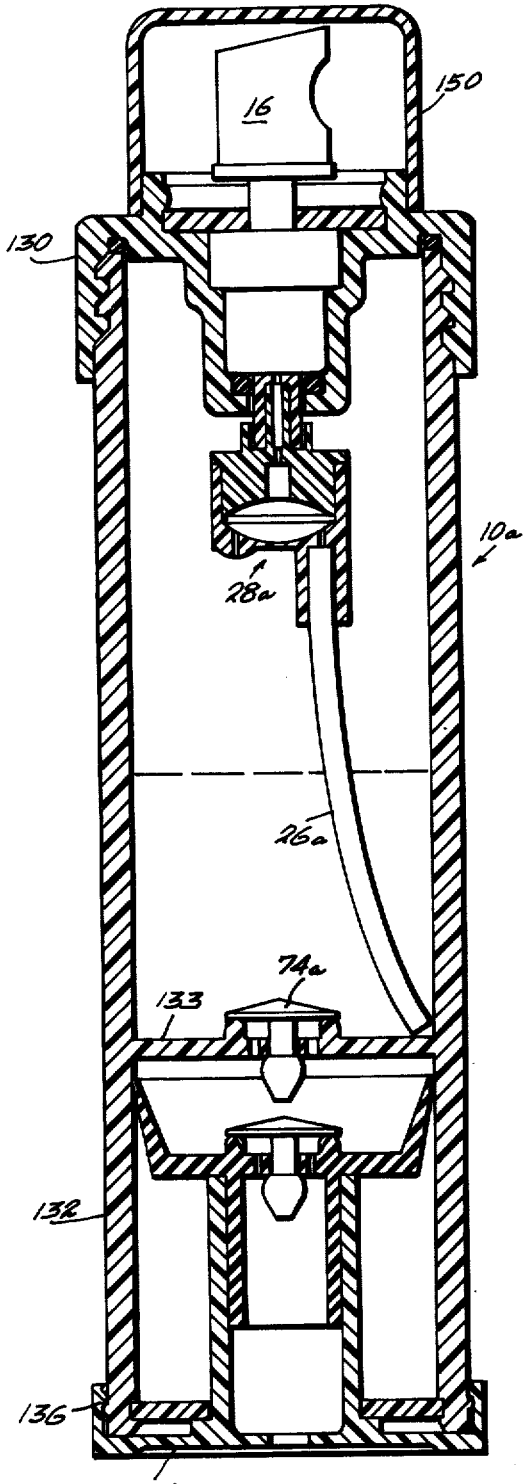
FIG. 15 is a side elevational view of the preferred embodiment of a dispensing apparatus embodying principles of the present invention showing the overcap and nozzle actuator in exploded relationship.

FIG. 12 illustrates a further form of the present invention. The pump means 20'' is carried in the upper portion of the container 10'' and includes all of the operational elements of the second form of the invention. The handle is in the form of an upwardly extending stem 46'', having an air hole 102'' therethrough. Top closure means are provided in the form of an annular flange 64'' in screw-threaded engagement at 66'' with the top end portion of the container 10'', said flange 64'' being formed integral with the pump housing 38''. In this form the dip tube 26'', mixing device 28'' and spray nozzle 16'', in assembly, are carried in a cover plate 120, formed integral with the pump housing 38'' and annular flange 64''. The bottom closure 122 of the container 10'' is formed integral therewith and the entire pumping and dispensing assemblies are removable with the cover plate 120. It is not necessary to further describe FIG. 12 as the pumping and spraying means function in the same manner as the first two forms of the present invention with the exception that the container 10'' need not be inverted to perform the filling and pumping operations.

FIG. 13 illustrates a still further form of the present invention, substantially utilizing the same elements as the first and second forms with a somewhat different pump arrangement. The dip tube 26*a*, mixing means 28*a* and discharge nozzle 16, in assembly, are carried by a top cap 130, screw-threaded in a closing relation to the normally open top end of the container 10*a*.

This embodiment represents a minaturized form of FIG. 7 in which the bottom end portion 132 of the container 10*a* comprises the pump housing 38' of FIG. 7, being separated from the top portion of the container 10*a* by a transverse septum 133 carrying the one-way valve 74*a*. Otherwise, all of the elements of the pump and its functions are identical with FIG. 7 with the exception of the handle 134 which is in the form of an end cap, snap-fitted at 136 onto the normally open lower end of the pump housing portion 132.

Figure 14:
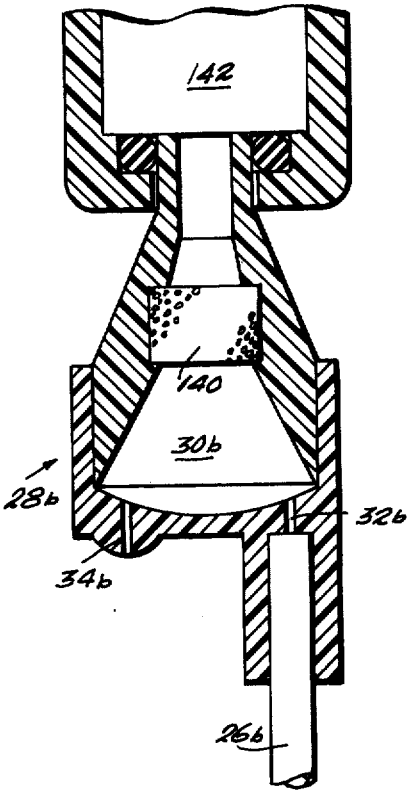
FIG. 14 is an enlarged vertical cross sectional view illustrating a foaming means, adaptable to all forms of the invention.

FIG. 14 is a modified form of mixing means 28*b* which is interchangeable with the mixing chambers on all of the disclosed forms of the present invention. The mixing means 28*b* provides a mixing chamber 30*b* providing a first orifice 32*b* connecting from the dip tube 26*b* to convey a liquid to be foamed from the container into the mixing chamber 30*b* under pressure. A second orifice 34*b* delivers a high velocity jet stream of air from the head portion of the container which automatically produces instant foam as it "blasts" the foam liquid. In turn, this bubbly foam is forced through the cellular or foraminous material 140 which automatically reduces the air bubbles and creates a true fine foam to be dispensed via the foam valve 142 and spout (not shown). The foam density may be controlled by the cellular structure of the foraminous material 140. All of the forms of the present invention may be provided with conventional protective, snap-on covers as indicated at 150.

The remaining drawing figures disclose the presently preferred embodiment of a dispensing apparatus incorporating the principles of the present invention, and this embodiment possesses further inventive features beyond those found in the preceding embodiments. FIGS. 15–22 disclose details of this presently preferred embodiment, and FIGS. 23–27 disclose various operative positions thereof.

Turning first to FIGS. 15–22, the dispensing apparatus 200 comprises a generally cylindrical container 202 having upper and lower container elements 204 and 206, respectively, which are screwed together, preferably by means of mating buttress threads 208. Since dispensing apparatus 200 is intended for relatively low pressure operation (i.e., the maximum pressure within the container less than approximately 25 to 40 pounds per square inch (psi)), container elements 204 and 206 can be advantageously (and are preferably) molded from plastic, for example, polypropylene or the like. An aerosol dispensing valve 210 is disposed centrally of the top wall of upper container element 204, and a pumping and reset mechanism 212 is disposed centrally of the bottom wall of lower container element 206. Dispensing valve 210 is constructed to accommodate conventional nozzle actuators, for example, the push button nozzle actuator 214 shown in FIG. 15 and the top of container element 204 is shaped to accommodate standard sized overcaps, for example, the overcap 216 shown in FIG. 15.

Although certain specific features of the present invention relate to aerosol dispensing apparatus, many features of the present invention are suited for dispensing a variety of flowable products in various forms other than as aerosols. The product to be dispensed can be a pure liquid, a mixture of liquids, a solution, a suspension, a fine powder, or any other similar type product capable of being dispensed from a container by means of a pressurized gas propellant in the container. The terms aerosol and aerosol spray are intended to denote a dispensation consisting of both propellant (i.e. compressed air) and product (i.e., liquid, powder, etc.). The aerosol can be in a foam or other form. The invention is additionally suited to dispense product only in a jet or a stream. If desired the product can be air, in which case the container would be pressurized with air alone, to dispense a jet of compressed air.

Filling of dispensing apparatus 200 is accomplished by removing upper container element 204 and introducing product to be dispensed into the lower container element 206. One or more circular ribs 218 can be molded around the inside of lower container element 206 at desired levels to provide a scale against which the level of the product in lower container element 206 can be visually gauged. After the desired quantity of product has been introduced into lower container element 206, the two container elements are threaded together to close the container. An O-ring seal 220 is preferably lodged in a groove in one of the two container elements so as to tightly seal the interior of the container with a leak-proof pressure-tight seal when the two container elements are threaded together. The closed container is now ready to be pressurized by means of the pump portion of the pumping and reset mechanism 212.

Pumping and reset mechanism 212 comprises a generally cylindrical tubular side wall 221 formed integrally with and extending centrally upwardly from the bottom wall 206*a* of lower container element 206. Side wall 221 defines a pumping chamber 222 within which a piston assembly 230 is slidably arranged for lengthwise reciprocation and is operable to intake air into pumping chamber 222 and then compress and force the same into the interior of container 202 to pressurize the headspace of the container. A conical wall 223 continues from the upper end of side wall 221 tapering inwardly and upwardly to define at its tip a central circular orifice 224. As seen in both FIGS. 16 and 17, four upright posts 226 are fashioned integrally with and spaced apart around cone 223 and serve to centrally mount a check valve element 228 operatively associated with orifice 224. Check valve element 228 comprises a circular ring portion 228*a* suitably shaped to snap into complementary shaped recesses fashioned in the upper end of each post 226 and four spaced spokes 228*b* arranged projecting inwardly and downwardly from ring portion 228*a* to terminate at a closure portion 228*c* which normally sealingly engages orifice 224. A projecting tip 228*d* projects downwardly from closure portion 228*c* completely through and beyond orifice 224. As will be seen later, projecting tip 228*d* adapted to be engaged by the reset mechanism to bodily unseat check valve element 228 from orifice 224 when it is desired to depressurize the interior of the container. Check valve element 228 is advantageously and preferably made from low-density polyethelene plastic or the like. During pumping, when the pressure in pumping chamber 222 exceeds the pressure in the interior of the container it will cause the check valve element to unseat from orifice 224, thereby permitting at least a portion of the compressed air within pumping chamber 222 to pass through orifice 224 and into the interior of container 202 to fill same with propellant under pressure.

Piston assembly 230 comprises a tubular stem 232, an operating handle 234 affixed to the lower end of stem 232, and a cup-shaped piston 236 affixed to the upper end of stem 232. These elements are also advantageously made from plastic. Handle 234 has an inner tubular upright sleeve 234*a* which is telescopically press-fitted into the lower end of stem 232. In lower container element 206 a set of three stepped central circular recesses 206*b*, 206*c*, 206*d* form a transition between bottom wall 206*a* and side wall 221, and the end wall of handle 234 is provided with a recess 234*b* which nests within the first of the stepped recesses 206*b* when end wall 234*c* of handle 234 abuts bottom wall 206*a* of container. Handle 234 is further provided with an outer circular cylindrical flange 234*d* which telescopes over the lower end of container element 206 when handle end wall 234*c* abuts bottom wall 206*a* of the container. Handle 234 thus provides a convenient manually grippable handle which is grasped by the user of the dispenser and reciprocated longitudinally with respect to container 202 to thereby reciprocate piston assembly 230 within pumping chamber 222 to pressurize the interior of the container.

Figures 15, 16:
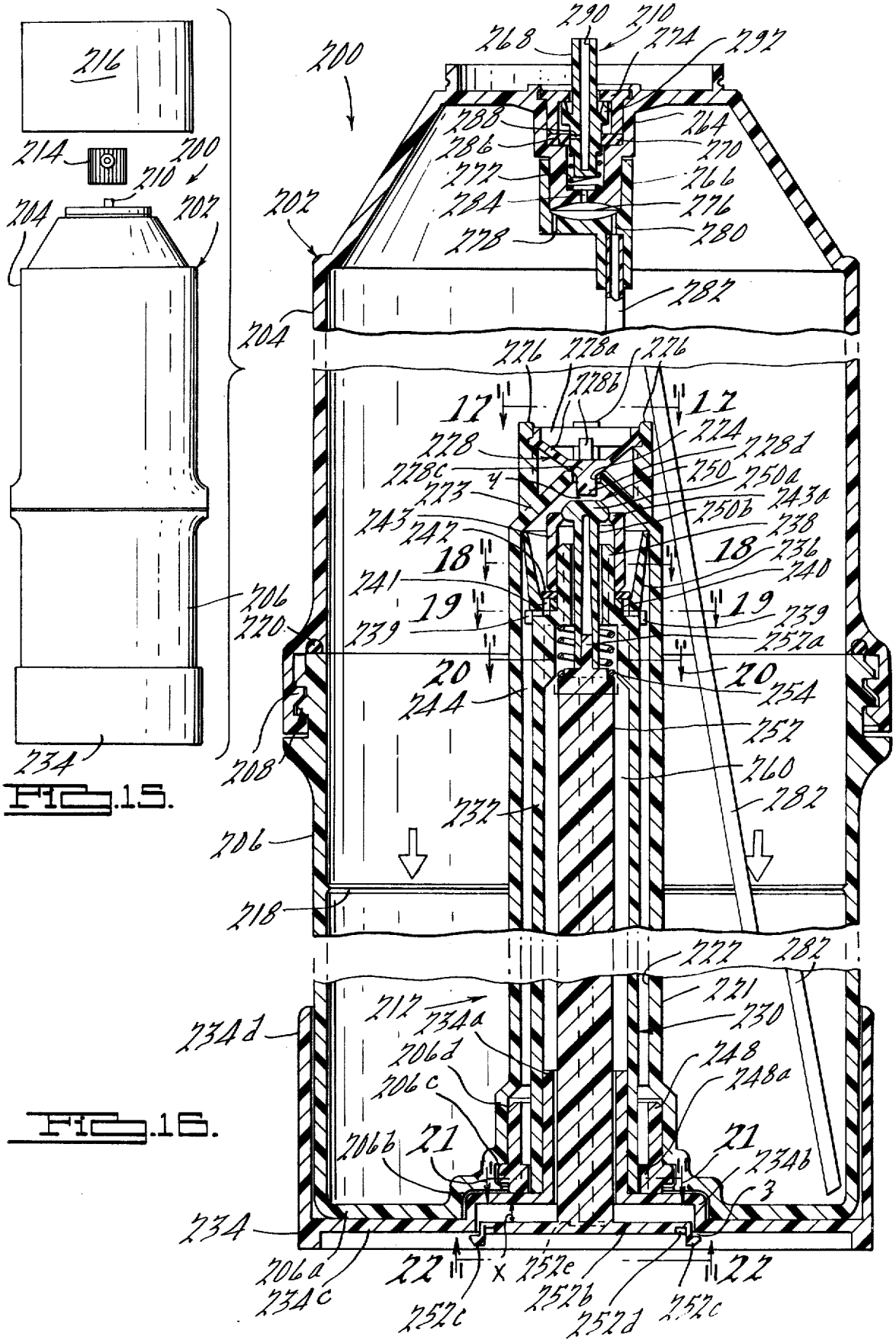
FIG. 16 is an enlarged vertical longitudinal, sectional view through the dispensing apparatus of FIG. 15 with portions broken away.
Figure 17:
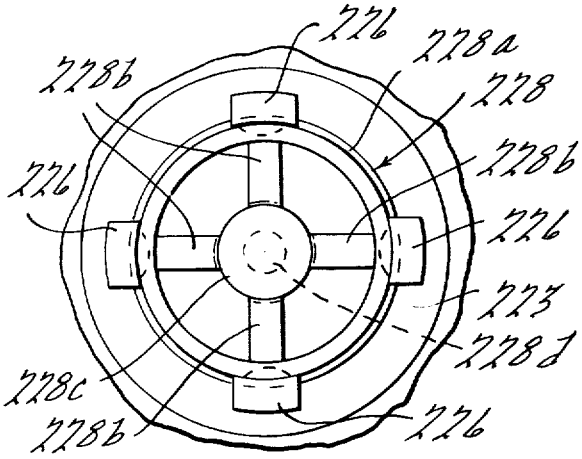
FIG. 17 is an enlarged horizontal view taken in the direction of arrows 17—17 in FIG. 16.
Figure 19:
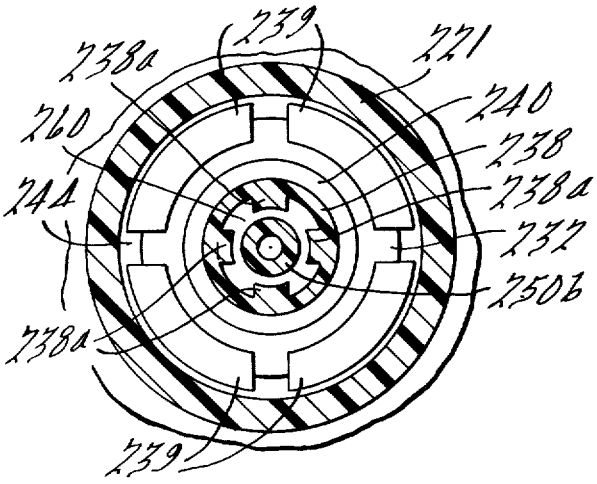
FIG. 19 is an enlarged, horizontal, transverse, sectional view taken along line 19—19 in FIG. 16.
Figure 20:
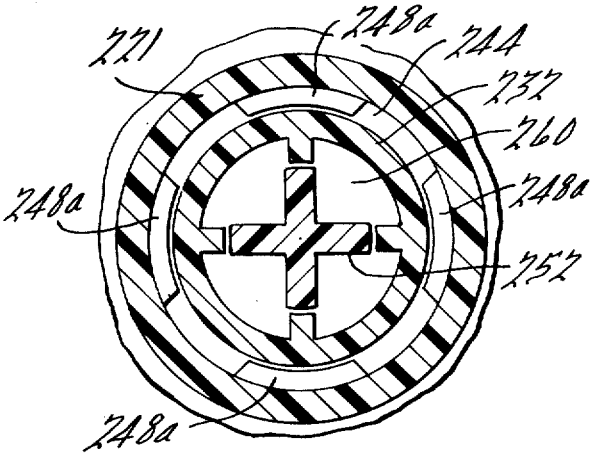
FIG. 20 is an enlarged, horizontal, transverse, sectional view taken along line 20—20 in FIG. 16.

Piston 236 has a relatively large circular hole in the end wall thereof to permit the piston to fit over a tubular projecting tip 238 fashioned at the upper end of stem 232. Piston 236 seats on a plurality of four arcuate ribs 239 and a ledge 240 fashioned on stem 232 (see FIG. 19). A plurality of circumferentially spaced openings 241 (FIG. 16) extend through the end wall of piston 236 and a flat annular elastomeric piston valve element 242, preferably made from Buna-N rubber or the like, is inserted over projecting tip 238 and seats within piston 236 to normally close openings 241. Both piston 236 and valve element 242 are retained on stem 232 by means of a generally tubular sleeve 243 which is pressed onto tip 238. As can be seen in FIGS. 16 and 20, an annular intake passage 244 is defined between the outside wall of stem 232 and the inside wall of pumping chamber 222. Ribs 239 are arranged such that passage 244 communicates with openings 241. As will be seen later in connection with description of FIG. 23, this construction causes valve 242 to unseat and permit outside air to fill pumping chamber 222 when piston assembly 230 is operated on the intake stroke.

Figure 21:
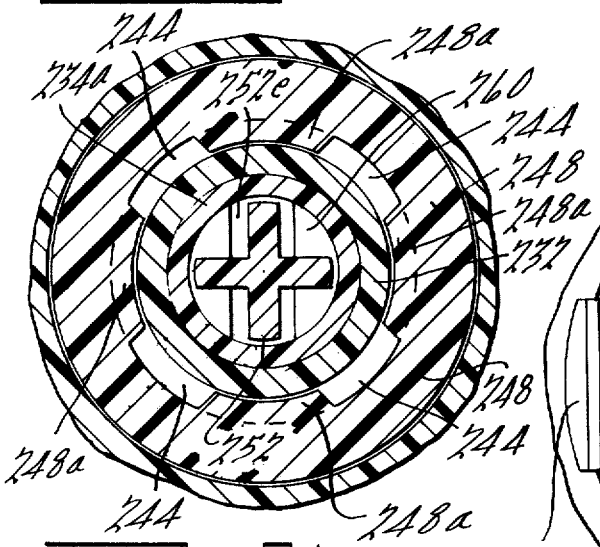
FIG. 21 is an enlarged, horizontal, transverse, sectional view taken along line 21—21 in FIG. 16.
Figure 22:
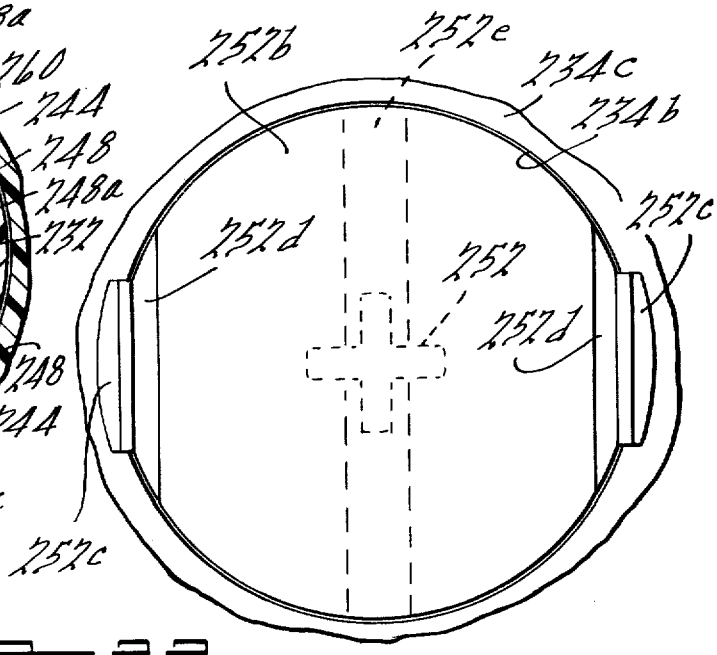
FIG. 22 is an enlarged, horizontal, transverse, view taken in the direction of arrows 22—22 in FIG. 16.

Piston assembly 230 is retained within pumping chamber 222 by means of an annular retainer element 248 which fits within recesses 206*c*, 206*d* in the bottom of lower container element 206, snap fitting within the former. As best seen in FIG. 21, retainer element 248 is provided with a plurality of circumferentially spaced projections 248*a* which are disposed for abutment with ribs 239 when the piston assembly is displaced fully downwardly with respect to the container to prevent piston assembly 230 from being pulled out of pumping chamber 222. The intervening spaces between projections 248*a* are open to the outside and form a continuation of intake passage 244, whereby outside air is permitted to pass through passage 244 and into pumping chamber 222 when piston assembly 230 is operated on the intake stroke.

A further inventive feature resides in the novel reset control mechanism carried by piston assembly 230 and operable to provide novel and advantageous functions not heretofore attained in dispensing apparatus of this type. The reset control mechanism comprises a reset control element 250, an actuator element 252, both preferably made of plastic, and a relatively weak helical compression spring 254. Reset control element 250 comprises a solid head 250*a* and a tubular stem 250*b* extending downwardly from head 250*a*. A tip 252*a* on element 252 is press-fitted into the lower end of stem 250*b* to join elements 250 and 252 together. Actuator element 252 is of cross-shaped cross section (see FIGS. 20–22) extending completely through stem 232 of piston assembly 230 and sleeve 234*a* of handle 234 to terminate in a circular exterior actuating button 252*b* aligned with recess 234*b*. Spring 254 is disposed between actuator element 252 and piston stem 232 so as to bias elements 250 and 252 downwardly with respect to piston assembly 230 to the position illustrated in FIG. 16. In this position, head 250*a* sealingly engages the upper edge of an orifice 243*a* provided at the upper end of sleeve 243. Actuating button 252*b* is intended to be pressed upwardly with respect to piston assembly 230 and can be fully lodged within recess 234*b*, however, a pair of diametrically opposed, integral, resilient catches 252*c* on button 252*b* (FIG. 22) project outwardly beyond recess 234*b* and normally tend to interfere with full insertion of the button into recess 234*b*.

In the position illustrated in FIG. 16 (i.e., with the piston assembly displaced fully upwardly within the pumping chamber) it will be observed that catches 252*c* are spaced longitudinally from recess 234*b* a distance *z* and that head 250*a* is spaced longitudinally a distance *y* below tip 228*d*. Button 252*b* can be relatively freely displaced upwardly against the force of spring 254 the distance *z* until catches 252*c* abut recess 234*b* at which time continued upward displacement of actuating button 252*b* requires increased effort since catches 252*c* must be cammed inwardly to clear the recess. Flexing of catches 252*c* is, however, facilitated by the provision of grooves 252*d*. Button 252*b* is capable of being displaced a total distance *x* until it fully lodges within recess 234*b*. Pursuant to certain of the inventive principles disclosed herein, the distances *x*, *y* and *z* are selected to permit head 250*a* to unseat from orifice 243*a* but not engage tip 228 *d* when button 252*b* is displaced the distance *z*, and to cause head 250*a* to bodily unseat valve 228 from orifice 224 but not engage conical wall 223 when button 252*b* is displaced the distance *x*. As will be explained in greater detail later, these inventive features provide novel and advantageous operating characteristics for the dispenser.

Figure 18:
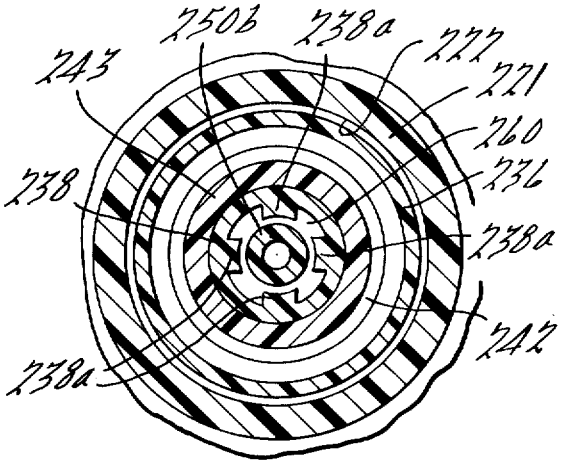
FIG. 18 is an enlarged, horizontal, transverse, sectional view taken along line 18—18 in FIG. 16.

An air escape passage 260 is provided between actuator element 252 and the inside wall of stem 232. Escape passage 260 communicates with orifice 243*a* via spaces between projections 238*a* within the tip 238 (FIGS. 18 and 19). The shape of actuating element 252 permits the same to be guided by sleeve 234*a*, and yet to provide a continuation of air escape passage 260 so that the passage 260 is open to outside at recess 234*b* (FIG. 21). A diametrical groove 252*e* is fashioned in the upper surface of actuating button 252*b* to maintain air escape passage 260 in communication with outside when button 252*b* is fully lodged within recess 234*b*. When the reset control mechanism is operated by depressing actuating button 252*b* distance *z*, head 250*a* unseats from orifice 243*a* to vent pumping chamber 222 via escape passage 260 to the outside. When the reset control mechanism is operated by depressing actuator button 250*b* the distance *x*, not only is pumping chamber 222 vented to outside via escape passage 260, but also check valve element 228 is bodily unseated to permit the pressurized air in the container headspace to escape via passage 260, thereby depressurizing the container.

Dispensing valve 210 comprises a cylindrical tubular body 264, an inlet element 266, a valve element 268, seal 270, a spring 272, and a retainer 274. Body 264 is advantageously integrally formed with upper container element 204 and the lower end thereof is diametrically reduced to receive inlet element 266 which is press-fitted thereon. Body 264 and inlet element 266 are shaped to define a mixing chamber 276 therebetween. Inlet port 278 in element 266 places the container headspace in communication with mixing chamber 276 and another inlet port 280 is extended by means of a dip-tube 282 to the bottom of the container to place product to be dispensed in communication with mixing chamber 276. An outlet passage 284 leads from mixing chamber 276 to the bore defined by body 264. This bore is diametrically enlarged to provide a shoulder 286 on which seal 270 seats. Retainer 274 is snap-fitted onto the upper end of the valve body to retain seal 270 against shoulder 286 and to retain valve element 268 within the valve body. Valve element 268 comprises a transverse radial passage 288 and a central axial passage 290. Spring 272 is disposed within body 264 to bias valve element 268 upwardly therein, with upward displacement of valve element 268 being limited by limiting means 292 which is biased against an inwardly directed lip on retainer 274. In the illustrated position, seal 270 prevents communication between passages 284 and 288. However, when valve element 268 is displaced downwardly, bore 286 is placed in communication with outlet passage 284 thereby providing a flow path from mixing chamber 276 through the lower portion of the valve body bore, through passage 288 and passage 290 and via nozzle actuator 214 to outside. Compressed air from the container headspace and product to be dispensed enter mixing chamber 276 wherein an aerosol is formed which is dispensed via valve 210 and nozzle actuator 214. It will be noted that valve 210 remains operable to dispense aerosol even if the container is held upside down. In this event, the compressed air will flow via dip-tube 282 and inlet 280 to the mixing chamber 276, while product to be dispensed will flow into the mixing chamber via inlet 278. It should also be noted that depending upon the nature of the product to be dispensed, other than an aerosol could be formed by the dispensing valve. A foaming valve such as shown in FIG. 14, or known valves of other types, may be used.

Figure 23:
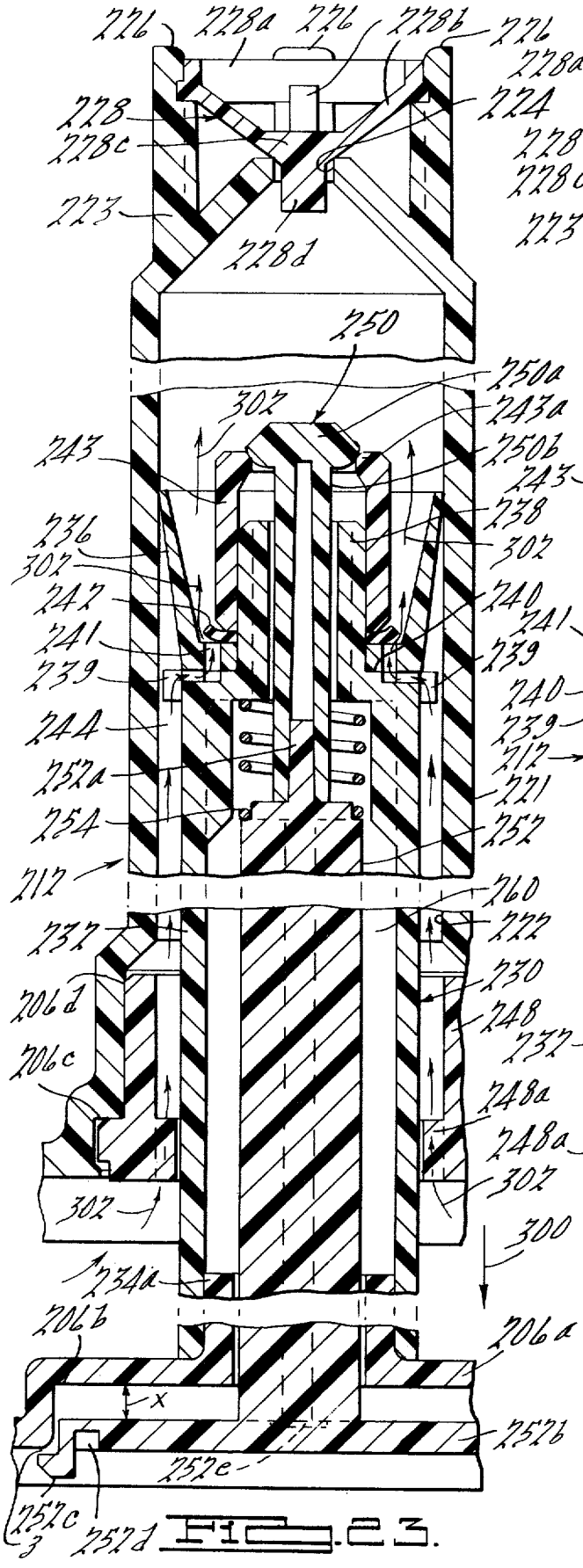
FIG. 23 is an enlarged, vertical, longitudinal, sectional view with portions broken away of the pumping and reset mechanism of the dispenser shown in FIG. 16 and illustrating the intake stroke of the pumping mechanism.

FIG. 23 illustrates the operation of the pumping mechanism during the intake stroke wherein handle 234 is displaced downwardly in the direction of arrow 300 with respect to container 202 to similarly displace piston 236 within pumping chamber 222. As piston 236 is displaced downwardly, a slight partial vacuum is created in pumping chamber 222 above piston 236. Due to the greater pressure of outside air acting upon the lower side of valve element 242 via intake passage 244 and openings 241, valve element 242 unseats from piston 236 as illustrated. This enables outside air to fill pumping chamber 222 above piston 236 as indicated by arrows 302. When the downward travel of the piston assembly is arrested at maximum piston displacement by abutment of ribs 239 with projections 248*a*, or at any intermediate displacement position, the pressures acting on valve element 242 are equalized and valve element 242 again seats on piston 236 to close openings 241.

Figure 24:
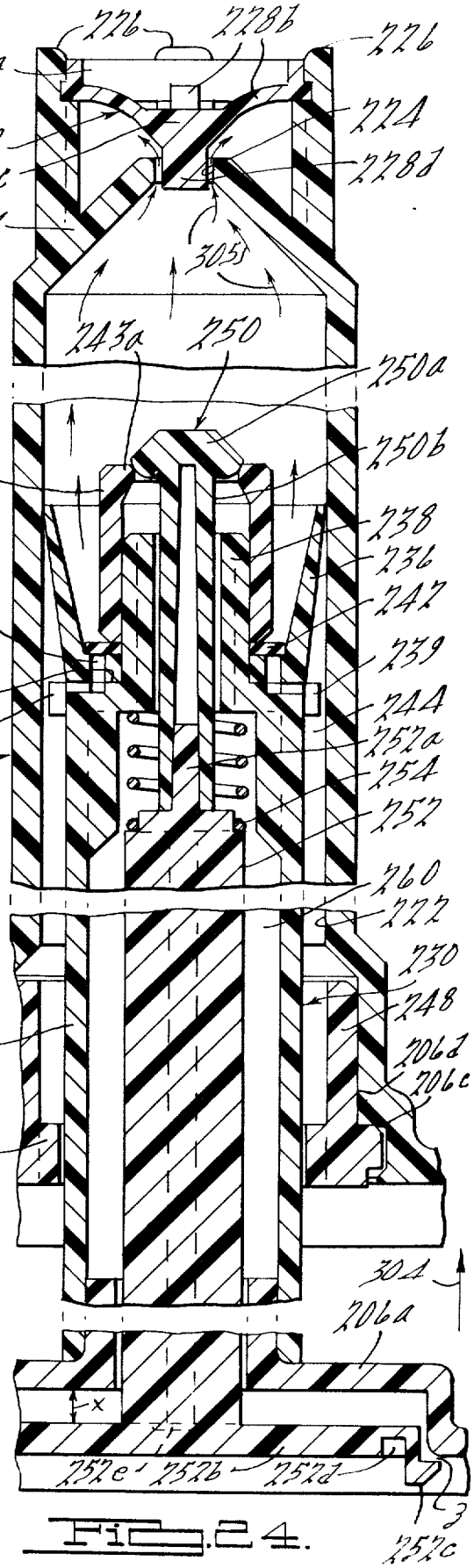
FIG. 24 is a view similar to FIG. 23 but illustrating the pressure stroke of the pumping mechanism.

FIG. 24 illustrates the upstroke, or pressure stroke, of piston assembly 230 wherein handle 234 is displaced upwardly in the direction of arrow 304 with respect to container 202 to similarly displace piston assembly 230. As piston assembly 230 is displaced upwardly within the pumping chamber, the increased air pressure causes the side wall of piston 236 to be more forcibly sealed against side wall 221, and valve element 242 to be more forcibly sealed against piston 236. The initial charge of air in the pumping chamber is increasingly compressed by piston 236 as the piston assembly is displaced upwardly. When the pressure in pumping chamber 222 above piston 236 exceeds the pressure within the headspace of the container by an amount sufficient to actuate check valve element 228, the check valve element unseats from orifice 224 (as shown in FIG. 24) to permit at least a portion of the charge of compressed air to pass through orifice 224 and into the container, as indicated by the arrows 305. When the upstroke is completed by handle 234 bottoming on the container, or earlier if desired, check valve element 228 again closes orifice 224 thereby preventing escape of the pressurized air within the container during the next downstroke of piston assembly 230. In this way, piston assembly 230 is manually reciprocated a number of times to pressurize the headspace of the container. As the pressure within the container increases, each charge of air in the pumping chamber must be increasingly compressed in order to develop the requisite pressure for forcing the air from the pumping chamber into the container.

Pursuant to one of the features of the invention, the pumping and reset control mechanism provides an automatic pressure release when the pressure in the container reaches a desired level. This condition is shown in FIG. 25. During the pumping operation, head 250*a* of the reset control mechanism remains seated on orifice 243*a*. However, as the pressure to which each charge of air in the pumping chamber must be compressed increases, the downward force caused by this pressure acting upon head 250*a* likewise increases. The upward force acting on head 250*a* is only that due to normal outside air pressure since the underside of head 250*a* is in communication with the atmosphere via air escape passage 260. Accordingly, when the pressure differential acting on head 250*a* reaches a predetermined level, sufficient net downward force acts on the reset control mechanism that the inherent resiliency of the materials used permits head 250*a* to be forced downwardly through orifice 243*a* and onto the upper end of tip 238, as indicated in FIG. 25. In practice, it actually snaps or pops open. In this position, the portion of pumping chamber 222 above piston 236 in effect is vented to outside, and therefore pressurized air within the pumping chamber is immediately exhausted as indicated by the arrows 306 in FIG. 25, and further pressurization of the container cannot occur. Venting of the chamber causes check valve element 228 to immediately close. By varying the relative dimensions of the parts as well as the materials of which they are formed, using known techniques, the mechanisms may be made to release at any desired pressure.

In addition, when the pressure releases button 252*b*, which is coupled with valve 250 via extension 252, is displaced downwardly with respect to handle 234 to a level below that of the end wall of the handle. Since air can no longer be compressed within the pumping chamber when piston assembly 230 is reciprocated, not only is the pressure within the container limited to a safe and desired level, but further, the piston assembly can be easily fully inserted into the pumping chamber to a retracted storage position with handle 234 telescoping over the lower end of the container. Because of this novel aspect of the preferred dispensing apparatus, the piston assembly can be displaced to the stored position without compressing air in the chamber and is maintained in the stored position by a gas lock and friction, without the need of separate mechanical interlocks or other arrangements. Storage is accomplished by first displacing the piston assembly fully upwardly and then depressing the extended actuating button 252*b* to push the head 250*a* of element 250 back through orifice 243*a* to seat the head on the orifice. The pumping chamber now is no longer vented to atmosphere via air escape passage 260. Sufficient frictional force exists between the piston side wall and the side wall of the pumping chamber to seal between the pumping chamber and the piston, and this sealing effect, coupled with the frictional force existing between the piston and the pumping chamber side wall, maintains the piston assembly fully retracted in the stored position.

Figure 27:
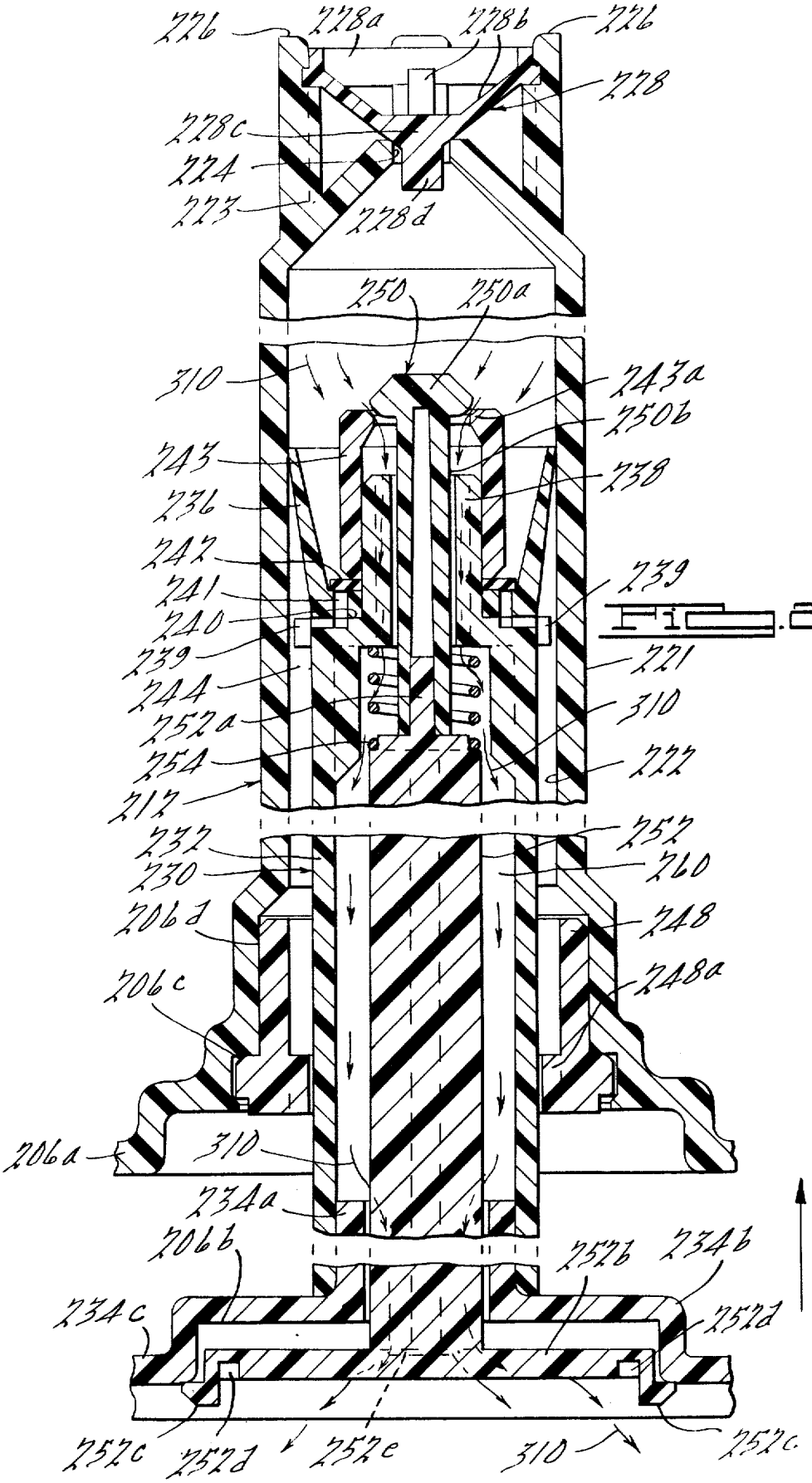
FIG. 27 is a view similar to FIG. 23 but illustrating an operative position of the reset mechanism which permits the pumping mechanism to be conveniently stored, regardless of the pressure within the dispenser.

FIG. 27 illustrates a further feature of the dispensing apparatus according to the invention which permits the piston assembly and handle to be easily stored when the container is pumped up to a pressure less than the preset maximum release pressure. By depressing push button 252*b* until catches 254*c* just abut the bottom of the handle (i.e., the distance *z*) the piston assembly can be easily displaced to the fully retracted storage position without compressing air in the pumping chamber since the unseating of element 250 vents pumping chamber 222 via passage 260, escape of air from pumping chamber 222 being shown by arrows 310. Once the piston assembly and handle are stored, push button 252*b* is released and spring 254 returns element 250 to seat on orifice 243*a*. The piston assembly is retained in storage in the fashion described above. When it is desired to once again pump up the dispenser, the handle may be grasped and pulled downwardly to overcome the holding force of the piston within the pumping chamber to crack valve 242 and draw air into the pumping chamber for compression on the subsequent upstroke.

A further feature of the invention is shown in FIG. 26, wherein button 252*b* is shown depressed fully the distance *x* into recess 234*b* to cause head 250*a* of element 250 to unseat from orifice 243*a* and to bodily unseat check valve element 228 from its seat on orifice 224. When element 250 is thus unseated, pumping chamber 222 vents to outside via escape passage 260, and with check valve element 228 also unseated pressurized air in the headspace of the container passes through orifice 224 to escape to the atmosphere via passage 260 (as shown by the arrows 307) thereby depressurizing the container. Since button 252*b* is fully lodged within recess 206*b*, air escapes from passage 260 via groove 252*e*. It will be noted that cone 223 provides a run-off for any product which may have come into contact therewith during use of the container, and this tends to insure that only air is exhausted from the container. The pressure within the container may be relieved in this fashion to any desired lesser pressure or may be completely depressurized. By utilizing the buttress-type thread 208 for attaching the upper and lower container elements to each other, the pressure in the container must be reduced almost to zero before thread friction is sufficiently reduced to a level where an ordinary person can exert enough torque to unthread the two container elements from each other. This is advantageous because it prevents the elements from being unscrewed while appreciable pressure still exists within the container. When push button 252*b* is released, spring 254 exerts a sufficient pressure to return the assembly to the position illustrated in FIG. 16. In use, the pressurized contents of the container may be dispensed by operating valve 210 as desired. When the pressure in the container drops below a desired level the pressure may be again increased by grasping the handle 234 and pumping the unit until the desired pressure is once again established in the interior of the container. When all the product has been dispensed from the container, remaining pressurized air in the container may be released either by operating valve element 210 or by operating push button 252*b*, the latter being much faster. Thereafter, the upper and lower container element may be unscrewed and the lower container element refilled with additional product to be dispensed. Thus, the invention has the advantage of being refillable with a minimum of effort and a maximum of safety to the user.

As mentioned earlier, the invention may be used to dispense product alone in a jet by blocking inlet port 278 and maintaining the lower end of dip-tube 282 in communication with the product being dispensed. When valve 210 is actuated, product alone is dispensed from the container under the force of the pressurized head.

Thus, there are disclosed in the above description and in the drawings embodiments of the invention which fully and effectively accomplish the objects thereof. However, it will be apparent that variations in the method may be indulged in without departing from the sphere of the invention herein described, or the scope of the appended claims.

What is claimed is:

1. Dispensing apparatus for dispensing an aerosol spray, jet, or the like, comprising: container means adapted to be only partially filled with product to be dispensed so as to leave a headspace therein; inlet passage means; check valve means arranged to permit a gas to enter said container means from said inlet passage means only when the pressure acting on said check valve means from said inlet passage means exceeds the pressure acting on said check valve means from inside said container means, whereby said headspace may be pressurized; and manually actuable unseating means for bodily unseating said check valve means and placing the inside of said container means in communication with said inlet passage means to permit gas in said headspace to be released from said container means via said check valve means.

2. Dispensing apparatus as claimed in claim 1, wherein said unseating means includes manually actuable actuator means arranged for limited displacement over a predetermined distance, said inlet passage means having a normally closed relief valve means disposed therein, said actuator means including means for unseating said relief valve means to open said inlet passage means when said actuator means is displaced in one direction an initial increment of said predetermined distance.

3. Dispensing apparatus as claimed in claim 2, wherein said actuator means can be actuated to unseat said check valve means only when said actuator means is displaced in said direction a distance greater than said initial increment of said predetermined distance.

4. Dispensing apparatus as claimed in claim 1, wherein said container means includes manually actuable pumping means for pressurizing said headspace through said inlet passage means.

5. Dispensing apparatus as claimed in claim 1, wherein said inlet passage means includes relief valve means and wherein said unseating means is also manually actuable to unseat and thereby open said relief valve means.

6. Dispensing apparatus as claimed in claim 5, wherein said unseating means cannot unseat one of said valve means without first unseating the other of said valve means.

7. Dispensing apparatus as claimed in claim 5, wherein actuation of said unseating means causes said relief valve means to unseat prior to said check valve means.

8. Dispensing apparatus as claimed in claim 5, wherein said relief valve means is arranged to automatically open in response to a predetermined pressure in said inlet passage means, said unseating means being operable to close and reset said relief valve means.

9. Dispensing apparatus for dispensing an aerosol spray, jet, or the like, comprising: container means adapted to be only partially filled with product to be dispensed so as to leave a headspace therein; check valve means arranged to permit a gas to enter said container means only when the pressure acting on said check valve means from outside said container means exceeds the pressure acting on said check valve means from inside said container means whereby said headspace may be pressurized; manually actuable unseating means for bodily unseating said check valve means to permit gas in said headspace to be released from said container means via said check valve means, said unseating means including manually actuable actuator means arranged for limited displacement over a predetermined distance; and an escape passage having a normally closed relief valve means disposed therein, said relief valve means being arranged to automatically open said escape passage in response to a predetermined pressure in said passage, said actuator means including means for unseating said relief valve means to open said escape passage when said actuator means is displaced an initial increment of said predetermined distance, said actuator means also being operable to close and reset said relief valve means after it has automatically opened.

10. Dispensing apparatus for dispensing an aerosol spray, jet, or the like, comprising: container means; a pumping mechanism forming a part of said container means and comprising a pumping chamber and a pumping means within said pumping chamber for taking atmospheric air into said pumping chamber and forcing it into said container means; and valve means for venting said pumping chamber, said valve means being manually operable to vent said pumping chamber to atmosphere without actuating said pumping mechanism to thereby render said pumping means incapable of forcing air into said container means.

11. Dispensing apparatus as claimed in claim 10, wherein said valve means is a relief valve operable to automatically open to vent said pumping chamber when the pressure therein exceeds a predetermined value.

12. Dispensing apparatus as claimed in claim 11, further comprising manually actuable means for closing and resetting said relief valve after venting.

13. Dispensing apparatus as claimed in claim 10, wherein said valve means is normally closed.

14. Dispensing apparatus as claimed in claim 10, wherein said pumping means comprises piston means and said valve means is carried by said piston means.

15. Dispensing apparatus as claimed in claim 10, wherein said piston means includes an escape passage therethrough and said valve means is arranged to vent said pumping chamber via said escape passage.

16. Dispensing apparatus as claimed in claim 15, further including manually operated actuator means arranged to extend through said escape passage and being manually displaceable with respect to said piston means to actuate said valve means.

17. Dispensing apparatus as claimed in claim 10, wherein said valve means comprises a valve seat defining an opening and a valve element normally sealingly engaging said opening, said seat and element being so dimensioned and having a resilience such that said valve element will pass through said opening when the pressure in said pumping chamber exceeds a predetermined value to thereby open said valve means and vent said chamber.

18. Dispensing apparatus as claimed in claim 17, further comprising manually operable means for displacing said valve element back through said opening to close and reset said valve means.

19. Dispensing apparatus as claimed in claim 17, further comprising manually operable means for displacing said valve element away from said seat to manually vent said pumping chamber.

20. Dispensing apparatus as claimed in claim 19, further comprising check valve means operatively disposed between said pumping chamber and the inside of said container means, said valve element being displaceable by said manually operable means to a position where it unseats said check valve means to thereby vent said container means.

21. Dispensing apparatus as claimed in claim 10, further comprising inlet passage means for placing said pumping mechanism in communication with the atmosphere, said valve means venting said pumping chamber through said inlet passage means.

22. Dispensing apparatus for dispensing an aerosol spray, jet or the like, comprising: container means; a pumping mechanism operable by the user of the dispensing apparatus to force atmospheric air into said container means to thereby pressurize said container means, said pumping mechanism comprising chamber means and pumping means within said chamber means, said pumping means being operable between a first position wherein a charge of air to be compressed by said pumping means is contained within said chamber means and a second position wherein the charge of air is compressed by said pumping means to an increased pressure so that a portion of the charge of air is forced into said container means; and means for sealingly storing said pumping means in the second position upon termination of the operation of said pumping means, said storing means comprising means for venting said chamber means to atmosphere upon termination of the operation of said pumping means so as to thus permit said pumping means to be operated to the second position without acting against a head of pressure in said chamber means, and means for sealing said pumping means with respect to said chamber means shen the pumping means is in the second position.

23. Dispensing apparatus for dispensing an aerosol spray, jet or the like, comprising: container means; a pumping mechanism operable by the user of the dispensing apparatus to force atmospheric air into said container means to thereby pressurize said container means, said pumping mechanism comprising chamber means and pumping means within said chamber means, said pumping means being operable between a first position wherein a charge of air to be compressed by said pumping means is contained within said chamber means and a second position wherein the charge of air is compressed by said pumping means to an increased pressure so that a portion of the charge of air is forced into said container means, said pumping means including a normally closed passage extending therethrough to the atmosphere; control means which can be manually actuated to open said passage and which also will automatically open said passage in response to a predetermined pressure therein to vent said chamber, and which can thereafter be manually actuated to close said passage; and means for sealingly storing said pumping means in the second position upon termination of the operation of said pumping means.

24. Dispensing apparatus for dispensing an aerosol spray, jet or the like, comprising: container means; a pumping mechanism operable by the user of the dispensing apparatus to force atmospheric air into said container means to thereby pressurize said container means, said pumping mechanism comprising chamber means and pumping means within said chamber means, said pumping means being operable between a first position wherein a charge of air to be compressed by said pumping means is contained within said chamber means and a second position wherein the charge of air is compressed by said pumping means to an increased pressure so that a portion of the charge of air is forced into said container means, said pumping means including a normally closed passage extending therethrough to the atmosphere; control means for opening said passage to vent said chamber means and for thereafter manually closing said passage; and means for sealingly storing said pumping means in the second position upon termination of the operation of said pumping means.

25. Dispensing apparatus for dispensing an aerosol spray, jet or the like, comprising: container means; user-actuable pumping means forming a part of said container means for intaking outside air and forcing the same into said container means to pressurize said container means; user-actuable dispensing means affixed to said container means; and control means manually actuable to first, second and third positions, said control means, when in said first position, permitting said pumping means to operate, when in said second position, preventing said pumping means from operating, and when in said third position, venting the interior of said container means to the atmosphere.

26. A low pressure dispensing apparatus comprising: a container providing an interior chamber, normally containing a predetermined amount of a substance to be dispensed; a self-contained, manually operated pump means in said container and including valve means communicating between said pump means and said interior chamber to transfer compressed air into said interior chamber to a predetermined pressure value when said pump means is actuated; means to disable said pump means when said predetermined pressure value is exceeded; and means to dispense the substance in said chamber under the influence of the head of pressure in said container; said pump means including a removable piston housing extending upwardly into said interior chamber from the bottom of said container, a flexible cup-shaped piston reciprocably disposed in an interior cylinder chamber formed within said housing, a tubular piston stem fixed to said piston and extending outwardly therefrom, and a handle at the outer end of said piston stem for manual manipulation of said piston said handle comprising an enlarged lower end of said tubular piston stem, including a peripheral flange to slip-fit upwardly over the outer lower peripheral end portion of said container; said removable piston housing including an enlarged lower end portion providing an upwardly extending, screw-threaded, peripheral flange for screw-threaded engagement within the lower peripheral end portion of said container.

27. A low pressure dispensing apparatus as defined in claim 26 including cooperating abutment means on said handle and said piston housing enlarged lower end whereby rotational movement of said handle is imparted to said piston housing to selectively remove or install said pump means relative to said container.

28. A low pressure dispensing apparatus comprising: a container providing an interior chamber, normally containing a predetermined amount of a substance to be dispensed; a self-contained, manually operated pump means in said container and including valve means communicating between said pump means and said interior chamber to transfer compressed air into said interior chamber to a predetermined pressure value when said pump means is actuated; means to disable said pump means when said predetermined pressure value is exceeded; and means to dispense the substance in said chamber under the influence of the head of pressure in said container; said pump means including a removable piston housing extending upwardly into said interior chamber from the bottom of said container, a flexible cup-shaped piston reciprocably disposed in an interior cylinder chamber formed within said housing, a tubular piston stem fixed to said piston and extending outwardly therefrom, and a handle at the outer end of said piston stem for manual manipulation of said piston; said means to disable comprising a manually actuated, snap-in plug closure means for the outer open end of said tubular piston stem, said snap-in plug closure means being designed to pop open automatically under the influence of back pressure generated in said cylinder and tubular piston stem when the pressure in said interior chamber exceeds said predetermined value.

29. A low pressure dispensing apparatus as defined in claim 28 wherein said snap-in plug includes an annular head about its inner end for engagement over an annular shoulder in said outer open end, and an outer push button shaped head.

30. A low pressure dispensing apparatus as defined in claim 29 wherein said snap-in plug closure means is confined in an annular chamber formed in an enlarged outer end portion of said tubular piston stem when said annular head is disengaged from said annular shoulder.

31. A low pressure dispensing apparatus as defined in claim 28 wherein said snap-in plug closure means is provided with an enlarged spring disc base portion.

32. A low pressure dispensing apparatus comprising: a container providing an interior chamber, normally containing a predetermined amount of a substance to be dispensed; a self-contained, manually operated pump means in said container and including valve means communicating between said pump means and said interior chamber to transfer compressed air into said interior chamber to a predetermined pressure value when said pump means is actuated; means to disable said pump means when said predetermined pressure value is exceeded; and means to dispense the substance in said chamber under the influence of the head of pressure in said container; said pump means including a removable piston housing extending upwardly into said interior chamber from the bottom of said container, a flexible cup-shaped piston reciprocably disposed in an interior cylinder chamber formed within said housing, a tubular piston stem fixed to said piston and extending outwardly therefrom, and a handle at the outer end of said piston stem for manual manipulation of said piston; said valve means comprising a one-way valve in an inner end closure of said removable piston housing, said one-way valve opening into said interior chamber from the upper end of said cylinder chamber, and a two-way valve axially disposed in said piston, said two-way valve being normally closed during each inward pumping stroke and open during each outward stroke; said means to disable comprising a plurality of radially disposed flutes about the annular inner edge of the valve seat of said two-way valve, said two-way valve being deformable on the instroke by an excess of pressure thereabove to open said flutes to the top of said cylinder chamber and to the atmosphere through said tubular piston stem.

33. A low pressure dispensing apparatus comprising: a container providing an interior chamber, normally containing a predetermined amount of a substance to be dispensed; a self-contained, manually operated pump means in said container and including valve means communicating between said pump means and said interior chamber to transfer compressed air into said interior chamber to a predetermined pressure value when said pump means is actuated; means to disable said pump means when said predetermined pressure value is exceeded; and means to dispense the substance in said chamber under the influence of the head of pressure in said container; said pump means including a removable piston housing extending upwardly into said interior chamber from the bottom of said container, a flexible cup-shaped piston reciprocably disposed in an interior cylinder chamber formed within said housing, a tubular piston stem fixed to said piston and extending outwardly therefrom, and a handle at the outer end of said piston stem for manual manipulation of said piston, said handle comprising an enlarged generally disc-shaped lower end of said tubular piston stem, normally recessed somewhat relative to an enlarged, generally concave extension of said piston housing, said concave extension including an upstanding peripheral flange in screw-threaded engagement with the lower end portion of said container, and a peripheral lock bead about the outer peripheral edge of said concave extension to cooperate with at least a portion of the peripheral edge of said generally disc-shaped lower end to provide a selective snap in and out engagement therebetween, finger grip openings being provided in said disc-shaped lower end.

34. A low pressure dispensing apparatus comprising: a container providing an interior chamber, normally containing a predetermined amount of a substance to be dispensed; a self-contained, manually operated pump means in said container and including valve means communicating between said pump means and said interior chamber to transfer compressed air into said interior chamber to a predetermined pressure value when said pump means is actuated; means to disable said pump means when said predetermined pressure value is exceeded; means to dispense the substance in said chamber under the influence of the head of pressure in said container; the lower end portion of said container defining an interior cylinder chamber for receiving a flexible cup-shaped piston for reciprocal movement therein, a tubular piston stem fixed to said piston extending outwardly therefrom and including a generally cap-shaped handle portion at its outer end, normally in screw-threaded engagement with the bottom edge of said lower end portion and being disengageable to provide for in and out manual pumping manipulations; a transverse septum generally separating said cylinder chamber from said interior chamber; said valve means comprising a one-way valve, axially disposed in said septum, opening into said interior chamber from the upper end of said cylinder chamber, and a two-way valve, axially disposed in said piston, said two-way valve being normally closed during each inward pumping stroke and open during each outward stroke; said means to disable comprising a plurality of radially disposed flutes about the annular inner edge of the valve seat of said two-way valve, said two-way valve being deformable on the instroke by an excessive build-up of pressure thereabove to open said flutes to the top of said cylinder chamber and to the atmosphere through said tubular piston stem.

35. Dispensing apparatus comprising: container means adapted to be only partially filled with product to be dispensed so as to leave a headspace therein, said container means being formed from plastic and comprising separate upper and lower container elements detachably coupled together in sealed relationship; user-actuable pumping means forming an integral part of said container means for intaking outside air and forcing the same into said container means to pressurize said headspace, said pumping means comprising a chamber defined by a cylinder having its lower end fashioned integrally with said lower container element and terminating at its upper end in a substantially conical wall, and a piston reciprocally arranged within said chamber, said piston being reciprocated by the user to pressurize said headspace; check valve means disposed at the apex of said conical wall arranged to permit air to enter said container means from said chamber when said piston is operated to compress the air in said chamber to a pressure greater than the pressure in said container means; control means carried by said piston and manually operable to physically unseat said check valve means, said control means including an escape passage means via which compressed air in said headspace can escape from said container means via said check valve means when the latter is unseated by said control means; relief valve means responsive to the pressure in said container means for automatically preventing said container means from being excessively pressurized; and user-actuable dispensing means affixed to said container means for dispensing said product in aerosol, jet or spray form by means of the pressurized air in said headspace.

* * * * *

UNITED STATES PATENT OFFICE

CERTIFICATE OF CORRECTION

PATENT NO. : 3,955,720

DATED : May 11, 1976

INVENTOR(S) : David C. Malone

It is certified that error appears in the above-identified patent and that said Letters Patent are hereby corrected as shown below:

Column 1, line 6, "invention" should be --application--

Column 4, line 36, "and 56" is omitted after "54"

Column 8, line 28, "is" is omitted after "228d"

Signed and Sealed this

Tenth Day of August 1976

[SEAL]

*Attest:*

RUTH C. MASON
*Attesting Officer*

C. MARSHALL DANN
*Commissioner of Patents and Trademarks*